United States Patent [19]

Klug

[11] Patent Number: 4,458,737

[45] Date of Patent: Jul. 10, 1984

[54] WOOD SPLITTER HEIGHT ADJUSTING MECHANISM

[75] Inventor: Alan G. Klug, Oshkosh, Wis.

[73] Assignee: Ingersoll Equipment Co., Inc., Winneconne, Wis.

[21] Appl. No.: 491,560

[22] Filed: May 4, 1983

[51] Int. Cl.[3] ..... B27L 7/00

[52] U.S. Cl. ..... 144/193 A; 144/193 K; 280/415 A; 403/87

[58] Field of Search ..... 144/193 R, 193 A, 193 K, 144/366; 280/415 R, 415 A; 83/928; 403/81, 84, 86, 87, 91, 93, 99

[56] References Cited

U.S. PATENT DOCUMENTS

| | | | |
|---|---|---|---|
| 3,760,854 | 9/1973 | Worthington | 144/193 A |
| 3,938,567 | 2/1976 | Dircksen et al. | 144/193 A |
| 4,258,765 | 3/1981 | Suomi | 144/193 A |

*Primary Examiner*—W. D. Bray

*Attorney, Agent, or Firm*—Dressler, Goldsmith, Shore, Sutker & Milnamow, Ltd.

[57] ABSTRACT

A self-elevating wood splitter is disclosed which includes an arrangement for selectively adjusting the vertical position of the wood-supporting frame of the splitter. The splitter includes a height adjusting arrangement which generally comprises a pair of four-bar linkages, and further includes an elevating mechanism which permits the hydraulic actuator of the splitter to be employed for operating the height adjusting arrangement to effect raising and lowering of the splitter's frame. A locking mechanism is provided which includes a pair of adjustment members operatively associated with the height adjusting mechanism of the splitter. Notably, the arrangement operates such that the wood-supporting frame can be raised by operation of the elevating mechanism before selective adjustment of the locking mechanism is effected. By this construction, the load on the locking mechanism can be relieved before adjustment, thus greatly facilitating convenient repositioning of the adjustment members to permit selective adjustment of the height of the splitter's wood-supporting frame.

16 Claims, 5 Drawing Figures

WOOD SPLITTER HEIGHT ADJUSTING MECHANISM

CROSS-REFERENCE TO RELATED APPLICATION

The present application is related to U.S. patent application Ser. No. 385,787, filed June 7, 1982.

TECHNICAL FIELD

The present invention relates generally to wood splitting devices adapted to be mounted on an associated tractor or like implement, and more particularly to an improved height adjusting mechanism for a self-elevating wood splitter or other attachment which facilitates convenient, selective vertical positioning of the wood splitter.

BACKGROUND OF THE INVENTION

Hydraulic wood splitting devices are known which are particularly suited for use in association with a tractor or like implement. Wood splitting devices of this nature are typically adapted for mounting on the associated implement, with a pressurized fluid source on the implement then providing power for operation of the splitter. These types of arrangements facilitate convenient and efficient wood splitting since mounting on the associated implement permits the wood splitter to be used at any desired location.

Commonly assigned application Ser. Nos. 385,787, filed June 7, 1982, and 380,687, filed May 21, 1982, illustrate hydraulically powered wood splitting devices which include self-elevating mechanisms for conveniently positioning the wood-supporting frame of the splitters in a plurality of vertical positions. Such arrangements are particularly convenient to use since the hydraulic actuator of the wood splitter itself can be employed for raising and lowering the wood-supporting frame. Such arrangements preferably include four-bar linkage mechanisms which maintain the wood-supporting frames in generally parallel relation to the ground, thus facilitating use at any selected elevation.

In the wood splitter arrangement disclosed in Ser. No. 385,787, a locking arrangement is provided for maintaining the wood-supporting frame of the splitter at the selected vertical position. The locking arrangement includes a pair of locking plates respectively fixedly connected to the lower links of each of the four-bar elevating linkage arrangements. Each locking plate defines a plurality of openings within which is positionable a latch pin carried by the upper link of the respective four-bar linkage. In order to adjust the height of the wood-supporting frame, the self-elevating mechanism is operatively connected with the hydraulically actuated ram of the splitter, and the ram then moved so that the elevating mechanism relieves the load on the latch pins. The latch pins can then be retracted from their respective locking plates, and the elevating mechanism further operated to reposition the wood-supporting frame at the desired elevation. The latching pins are then reinserted into their respective locking plates, with the splitter then ready for use at its new elevation.

While the provision of a self-elevating mechanism for a wood splitter greatly facilitates its convenient use, the above-described locking arrangement of application Ser. No. 385,787 can at times be difficult to use. Because the self-elevating mechanism cannot always be operated with precision, it is frequently difficult to use the mechanism for relieving the load on the latching pins of the arrangement, and then correctly vertically repositioning the wood-supporting frame so that the latching pins can be easily reinserted into their respective locking plates.

In view of the foregoing, it will be appreciated that it is desirable to provide a self-elevating wood splitter which includes a locking arrangement for its height adjusting mechanism which further facilitates convenient vertical repositioning of the wood-supporting frame of the splitter.

SUMMARY OF THE INVENTION

In accordance with the present invention, a self-elevating wood splitter is disclosed which includes an improved locking mechanism for maintaining the wood-supporting frame of the splitter at any of a plurality of vertical positions. Notably, the locking arrangement of the present wood splitter permits the wood-supporting frame of the splitter to be raised by its self-elevating mechanism before selective adjustment of the locking arrangement. After the frame has been raised, the locking arrangement can be easily selectively adjusted, and the frame then lowered with the locking arrangement limiting the downward movement thereof.

In the preferred form, the present hydraulic wood splitter is adapted for mounting on an implement, such as a tractor, and to this end includes a front mounting plate for effecting a fixed mounting on the implement. The splitter further includes a wood-supporting frame which is associated with the front mounting plate and extends rearwardly thereof.

In order to effect wood splitting, the present invention includes hydraulically actuated splitting means associated with the wood-supporting frame. In the illustrated embodiment, the splitting means include a splitting ram which is slidable along tubular support portions of the wood-supporting frame, with a hydraulic actuator provided for driving the splitting ram. The arrangement includes a cutting wedge which is adapted to coact with the splitting ram for effecting wood splitting attendant to operation of the hydraulic actuator. As will be recognized, the present invention is readily adaptable for embodiment as a so-called double-acting wood splitter, in which a hydraulic actuator drives a double-edged cutting wedge in opposite directions for coaction with a pair of splitting rams faces.

In order to permit selective vertical positioning of the wood-supporting frame of the splitter, a height adjusting arrangement is provided for movably connecting the wood-supporting frame to the front mounting plate. The height adjusting mechanism preferably includes a pair of first upper links and a pair of second lower links, in respective parallel relation, pivotally interconnecting the wood-supporting frame and the front mounting plate. A pair of four-bar linkage arrangements are thereby formed, with the desired results being that the wood-supporting frame is maintained in generally parallel relation to the ground at any desired elevation.

In keeping with the preferred self-elevating nature of the present splitter, an elevating mechanism is operatively associated with the height adjusting arrangement. In the illustrated embodiment, the elevating mechanism includes a pair of rigid arms respectively joined to one of the pairs of the pair of first upper links and the pair of second lower links. The rigid arms extend inwardly toward each other where they are connected with an elevating chain. The elevating chain is adapted to be selectively operatively connected to the hydraulically actuated splitting ram so that hydraulic operation of the splitting ram acts to raise and lower the wood-supporting frame.

In order to maintain the position of the wood-supporting frame at any desired elevation, a selectively adjustable locking mechanism is provided in association with the height adjusting mechanism. The locking mechanism includes a pair of adjustment members respectively associated with the four-bar linkage arrangements of the splitter. Each adjustment member is fixedly pivotally connected with one of its respective first and second links, and is selectively pivotally connectable with the other of its respective first and second links in a plurality of positions. A pair of latches respectively associated with the four-bar linkage arrangements permit the selective pivotal connection of each of the adjustment members by means of a plurality of arcuately spaced openings defined by each of the adjustment members.

In order to limit the downward movement of the wood-supporting frame, each of the adjustment members defines a first abutment surface which is adapted to engage and coact with a respective second abutment surface provided by by one of the links of each of the four-bar linkage arrangements. Notably, the first and second abutment surfaces coact to only limit the downward movement of the wood-supporting frame, but permit upward movement of the wood-supporting frame by operation of the elevating mechanism. By this important feature of the present invention, the wood-supporting frame can be easily raised by operation of the elevating mechanism before selective adjustment of the relative position of each of the adjustment members. After the elevating mechanism is operated to move the coacting first and second abutment surfaces out of engagement, the load is relieved on the latches which coact with the openings defined by each adjustment member. This permits very convenient selective repositioning of the adjustment members. The adjustment members are repositioned by disengaging the latches, and re-engaging the latches after the positions of the adjustment members have been similarly changed. The elevating mechanism of the splitter can then be again actuated to lower the wood-supporting frame until the cooperating first and second abutment surfaces are moved back into cooperating engagement, with the wood-supporting frame then being positioned at its new desired elevation.

Numerous other features and advantages of the present invention become readily apparent from the following detailed description and accompanying drawings.

DETAILED DESCRIPTION

Figure 1:
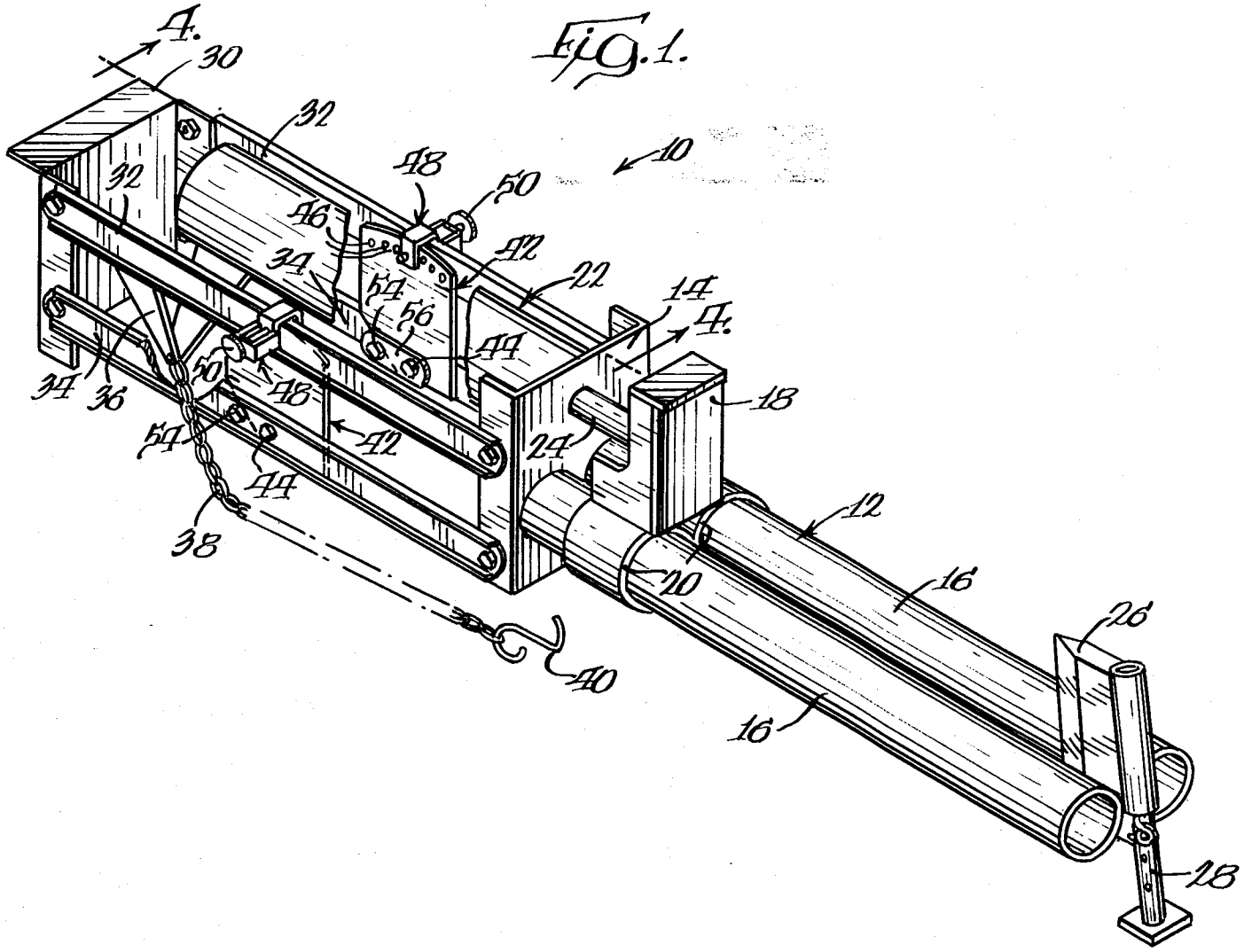
FIG. 1 is a perspective view of a wood splitter embodying the present invention.
Figure 2:
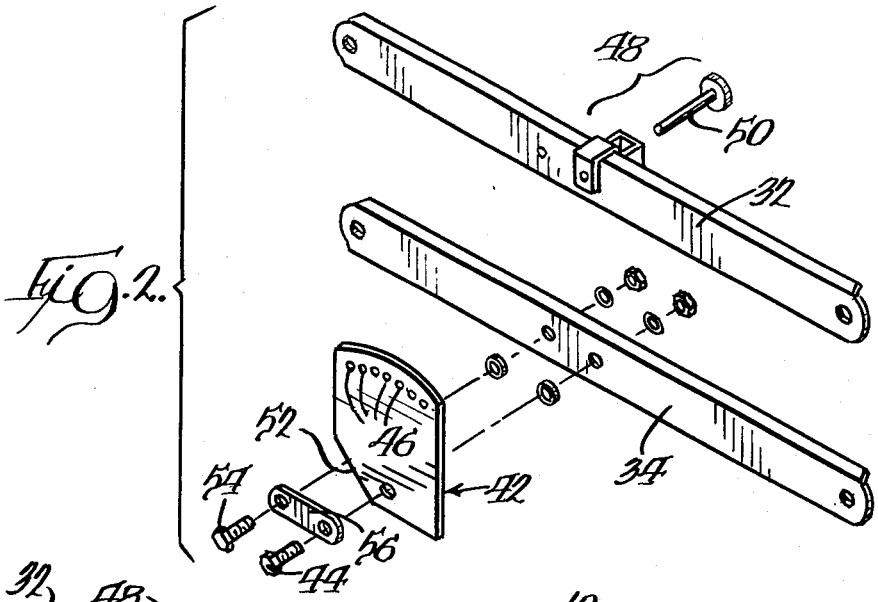
FIG. 2 is an exploded perspective view of a portion of one of the linkage arrangements of the wood splitter illustrated in FIG. 1.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Referring now to FIG. 1, therein is illustrated a self-elevating wood splitter 10 embodying the present invention. As will be recognized, wood splitter 10 is a so-called single-acting splitter, and is adapted to split wood attendant to operation in a single working direction. However, it will be recognized that the present invention is readily adaptable for embodiment as a so-called double-acting splitter, which typically includes a hydraulically driven double-edged cutting wedge which coacts with a pair of opposed abutment surfaces. As will be described, wood splitter 10 is self-elevating in the sense that it includes an elevating mechanism which permits the wood-supporting portion of the splitter to be easily selectively vertically positioned by the use of the hydraulic actuator of the splitter.

Wood splitter 10 includes a wood-supporting frame 12 which comprises a generally vertically oriented rear mounting frame plate 14 and a pair of tubular supports 16 which extend generally rearwardly of and are supported by frame plate 14. The splitter further includes a hydraulically driven splitter ram 18 which is adapted to slidingly move along tubular supports 16 by means of sliding collars 20 which are respectively slidingly disposed on tubular supports 16.

Splitter 10 includes a hydraulic actuator 22 mounted on frame plate 14 for driving splitting ram 18 during wood splitting operations. Piston rod 24 of actuator 22 is operatively connected with splitting ram 18 so that the actuator 22 is adapted to move splitting ram 18 in opposite directions along tubular supports 16 (even though wood splitting is effected only when splitting ram 18 is moved toward the free end of tubular supports 16).

In order to effect wood splitting, pieces of wood such as logs are positioned on tubular supports 16, with actuator 22 then operated to move splitting ram 18 so that the piece of wood is driven against a cutting wedge 26 positioned at the free ends of tubular supports 16. Cutting wedge 26 is preferably mounted on a support leg 28, with the support leg providing support for the free end of the splitter when the wood-supporting frame 12 of the splitter is positioned relatively close to the ground. When it is desired to operate the wood splitter with wood-supporting frame 12 in a relatively higher position, support leg 28 can be positioned atop a log or other conveniently available piece of material positioned between support leg 28 and the ground.

Wood splitter 10 is preferably mountable on a material handling implement such as a tractor or the like which is adapted to provide a source of pressurized hydraulic fluid for operation of the splitter. To this end, the splitter includes a front mounting plate 30 which is adapted for releasably fixedly mounting the wood splitter on an associated implement. This type of mounting facilitates convenient use of the splitter, since the implement upon which the splitter is mounted can be driven to any desired area for splitting, and the splitter readily set-up for operation.

In accordance with the present invention, splitter 10 includes a height adjusting mechanism to permit selective vertical positioning of wood-supporting frame 12. This type of selective height adjustment facilitates convenient use. For splitting pieces of wood which are relatively small and easily lifted, the wood supporting frame 12 can be positioned relatively high. For splitting relatively larger pieces of wood, the splitter can be positioned conveniently low to facilitate placement of the wood on tubular supports 16.

The height adjusting mechanism generally comprises a pair of four-bar linkage arrangements. Specifically, a pair of first upper links 32 extend between and are pivotally interconnected with mounting plate 30 and frame plate 14. A pair of second lower links, respectively arranged in parallel with upper links 32, also extend between and are pivotally interconnected with mounting plate 30 and frame plate 14. Thus, each four-bar linkage arrangement of the height adjusting mechanism includes mounting plate 30, one of each of upper and lower links 32 and 34, and frame plate 14. By this construction, frame plate 14 is adapted to be maintained in generally parallel relation to mounting plate 30 throughout the range of vertical adjustment of the splitter, with tubular supports 16 being constantly maintained in a generally horizontal disposition.

Figure 3:
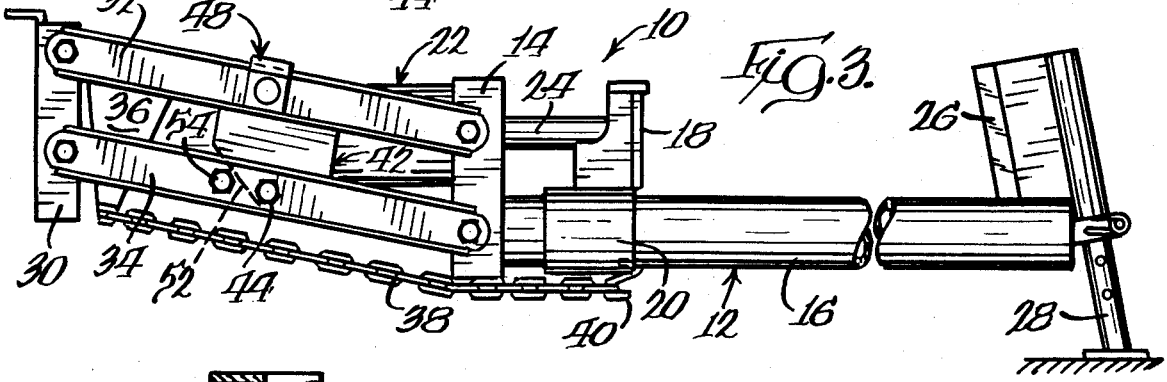
FIG. 3 is a side elevational view of the wood splitter illustrated in FIG. 1 showing operation of its self-elevating mechanism.

In order to facilitate selective vertical positioning of wood-supporting frame 12, splitter 10 includes a self-elevating mechanism which is adapted to impart the driving force of hydraulic actuator 22 to the four-bar linkage arrangements of the splitter's height adjusting mechanism. The elevating mechanism includes a pair of rigid arms 36 which are respectively affixed to one of the pairs of the pair of first upper links 32 and the pair of second lower links 34. In the illustrated embodiment, rigid arms 36 are respectively affixed to first upper links 32, and extend downwardly and generally inwardly therefrom toward each other. Rigid arms 36 are preferably joined to each other at their point of convergence, and an elevating chain 38, or a like flexible linkage member, affixed to rigid arms 36. As best illustrated in FIG. 3, a hook 40 connected to elevating chain 38 permits the elevating chain to be operatively connected with splitting ram 18 by way of its sliding collars 20. After chain 38 has been connected to the sliding collars 20 with ram 18 in a retracted position, operation of hydraulic actuator 22 acts to tension chain 38, which in turn creates a moment arm acting on upper links 32 via rigid arms 36.

In order to permit wood-supporting frame 12 to be maintained in any selected vertical position, the present wood splitter includes a locking mechanism operatively associated with the four-bar linkage arrangement of the splitter's height adjusting mechanism. In previously known self-elevating wood splitter constructions, a locking arrangement has typically been provided by one or more plates respectively affixed to either the upper or lower links of the height adjusting mechanism. Such locking plates have typically defined a plurality of holes within which a spring-loaded latch or the like could be selectively positioned. With such previous arrangements, it has been typically necessary to relieve the load on the latch mechanisms by operation of the splitter's elevating mechanism, and to then further operate the elevating mechanism to position the splitter at the new desired elevation. The latch mechanisms of such splitters are then operable in cooperation with the locking plates of the device to maintain the splitter at the new elevation.

Experience has shown that the locking mechanisms of previous self-elevating splitters can be problematical in use. Very precise operation of the splitter's hydraulic actuator is frequently required to properly alter the vertical positioning of the splitter. Such precise operation is frequently difficult and time-consuming, thus detracting from convenient use of such splitters.

In distinction, the locking mechanism of the present wood splitter permits upward movement of the wood-supporting frame 12 of the splitter by its elevating mechanism before the locking arrangement is selectively adjusted for positioning the frame 12 at a new elevation. This is a particularly important feature of the present invention since it greatly facilitates convenient adjustment of the splitter's vertical position.

The locking mechanism preferably includes a pair of locking adjustment members 42 which are respectively operatively associated with each pair of first upper links 32 and second lower links 34. Each adjustment member 42 is fixedly pivotally connected with one of the first and second links 32 and 34 of its respective pair of links. Thus, in the illustrated embodiment adjustment members 42 are respectively pivotally connected to lower links 34 intermediate the ends thereof with suitable mechanical fasteners 44.

In order to permit selective pivotal connection of each adjustment member 42 with the other of its respective first and second links 32 and 34 (i.e., upper link 32 in the illustrated embodiment), each adjustment member 42 defines a plurality of arcuately spaced locking openings 46 which are positioned radially about the fixed pivotal connection of each adjustment member at 44. Openings 46 permit each adjustment member 42 to be selectively pivotally interconnected with its respective upper link 32, intermediate the ends of the link, in a plurality of relative positions. To this end, a pair of releasable latch mechanisms 48 are respectively provided on upper links 32. Each latch mechanism includes a latch pin 50 adapted to be selectively positioned within one of the holes 46 of the respective one of adjustment members 42 for pivotally interconnecting each adjustment member 42 with its respective upper link 32. As will be recognized, the pivotal interconnection of each adjustment member 42 with both of its respective upper and lower links 32 and 34 results in movement of each adjustment member 42 in generally parallel relation to mounting plate 30 and frame plate 14 attendant to raising and lowering of the height adjusting mechanism of the wood splitter.

In order to limit the downward movement of the height adjusting mechanism of the splitter, and thus the downward movement of the wood-supporting frame 12, the locking arrangement for the height adjusting mechanism further includes an arrangement of coacting abutments. Specifically, each adjustment member 42 defines a first abutment surface 52. The abutment surface 52 of each member 42 is adapted to positively engage and act against a respective second abutment surface provided on one of upper and lower links 32 and 34. Accordingly, an abutment fastener 54 is fixedly mounted on each of lower links 34 for coaction with the abutment surface 52 of the respectively associated one of adjustment members 42. Support brackets 56 can be respectively provided in association with fastener 44 and fastener 54 to assure that the abutment fasteners 54 are securely maintained in position on their respective lower links 34.

Figure 4:
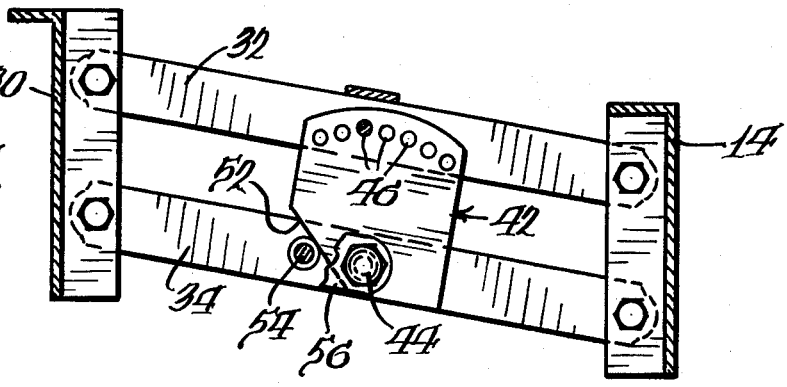
FIGS. 4 and 5 are cross-sectional views taken generally along lines 4—4 of FIG. 1 further illustrating operation of the height adjusting mechanism of the present wood splitter.

From the foregoing description of the present wood splitter construction, its operation for height adjustment of wood-supporting frame 12 will be readily apparent. When the wood-supporting frame 12 is positioned at any selected vertical elevation, the first abutment surfaces 52 of adjustment members 42 respectively abut and positively engage abutment fasteners 54. This is best illustrated in FIG. 4. When it is desired to alter the elevation of wood-supporting frame 12, elevating chain 38 of the splitter's elevating mechanism is operatively connected with its hydraulically driven ram 18. Actuator 22 is then operated so that splitting ram 18 tensions elevating chain 38, thus raising the wood-supporting frame 12. By this action, abutment surfaces 52 of each adjustment member 42 is moved out of engagement with its respective abutment fastener 54. It will be noted that the nature of the locking mechanism of the present splitter permits this elevating action without withdrawal of latch pins 50 from their respective openings 46 in adjustment members 42.

Before the relative positions of adjustment members 42 are changed, wood-supporting frame 12 is raised by the elevating mechanism sufficiently to permit selective positioning of adjustment members 42. For example, if wood-supporting frame 12 is to be positioned above its initial position, the wood-supporting frame 12 is preferably first raised somewhat beyond its desired final position. In contrast, if the frame 12 is to be lowered from its initial position, the elevating mechanism of the splitter need only be operated sufficiently to relieve the load between abutment surfaces 54 and adjustment fasteners 54.

Figure 5:
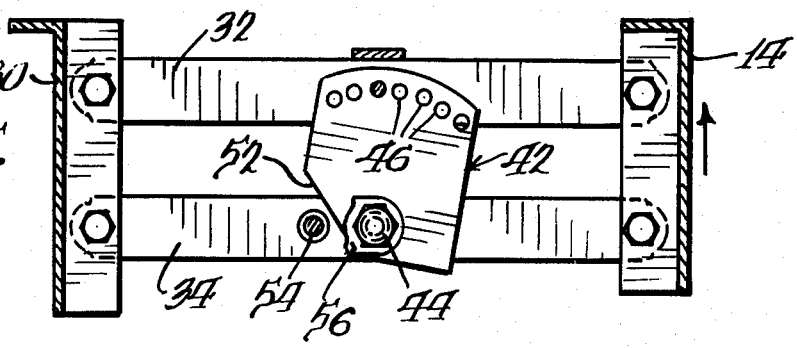

Once the load on adjustment members 42 has been relieved and the height adjusting mechanism of the splitter operated by the elevating mechanism sufficiently to permit the desired repositioning of the adjustment members, latch pins 50 can be easily withdrawn from their respective openings 46. Each adjustment member 42 can then be correspondingly repositioned by pivotal movement about its respective fastener 44. Referring to the orientation of FIGS. 4 and 5, adjustment members 42 are pivoted clockwise to permit repositioning of frame 12 in a relatively lower elevation, while the adjustment members are pivoted counterclockwise to permit repositioning of frame 12 at a relatively higher elevation.

After adjustment members 42 have been correspondingly pivotally repositioned, latch pins 50 are reinserted into the adjustment members in different ones of the holes 46 (bearing in mind that during this adjustment the tension within chain 38 acts to support the splitter and keep it from dropping). After latch pins 50 have been reinserted into adjustment members 42, hydraulic actuator 22 can again be operated to move splitting ram 18, and thus relieve the tension in chain 38. As this occurs, wood supporting frame 12 is lowered until abutment surface 52 of each adjustment member 42 re-engages its respective abutment fastener 54. The positive engagement of the respective abutment surfaces thus limits the downward movement of the wood-supporting frame 12. Elevating chain 38 can then be detached from splitting ram 18, and the wood-splitting operation can then proceed.

As will be recognized from the foregoing description, the present invention greatly facilitates convenient selective adjustment of the vertical position of the wood-supporting portion of the wood splitter 10. As noted, the present invention can be readily adapted for embodiment as a double-acting wood splitter, and can be readily configured for operation in association with self-elevating mechanisms other than as disclosed.

It will be further recognized that the height adjustment mechanism embodying the present invention can be adapted for other applications for mounting an attachment on an implement for adjustable vertical movement. The provision of the four-bar linkage arrangements, including front mounting plate 30, upper and lower links 32 and 34, and rear mounting plate 14, desirably permits an attachment supported on rear mounting plate 14 to be maintained at a constant orientation (such as horizontal) as it is vertically moved with respect to an implement upon which it is mounted. For such applications, the selectively and easily adjustable nature of the locking arrangement, including one or more adjustment members 42, facilitates very convenient vertical positioning of an attachment.

From the foregoing, it will be observed that numerous variations and modifications may be effected without departing from the true spirit and scope of the concept of the present invention. It will be understood that no limitation with respect to the specific apparatus illustrated herein is intended or should be inferred. It is, of course, intended to cover by the appended claims all such modifications as fall within the scope of the claims.

What is claimed is:

1. A hydraulic wood splitter adapted to be mounted on an implement, comprising:

front mounting means for effecting a fixed mounting on said implement;

a wood-supporting frame connected with said front mounting means and extending rearwardly therefrom;

hydraulically actuated splitting means carried by said wood-supporting frame and movable therealong;

height adjusting means movable connecting said wood-supporting frame and said splitting means to said front mounting means;

elevating means connected with said height adjusting means and selectively movable into operative connection with said splitting means so that movement of said splitting means effects raising and lowering of said wood-supporting frame; and selectively adjustable locking means for releasably locking said wood-supporting frame at a plurality of elevations, said locking means permitting upward movement of said wood-supporting frame by said elevating means before selective adjustment of said locking means.

2. The hydraulic wood splitter in accordance with claim 1, wherein said height adjusting means comprises first and second link means pivotally interconnecting said wood-supporting frame and said front mounting means to form four-bar linkage means.

3. The hydraulic wood splitter in accordance with claim 2, wherein said locking means comprises adjustment member means fixedly pivotally connected with one of said first and second link means, and selectively pivotally connectable with the other of said first and second link means in a plurality of positions.

4. The hydraulic wood splitter in accordance with claim 3, wherein said locking means further comprises first abutment means defined by said adjustment member means, and second abutment means on one of said first and second link means, said first and second abutment means being adapted to positively engage each other to limit downward movement of said wood-supporting frame attendant to operation of said elevating means by said splitting means.

5. The hydraulic wood splitter in accordance with claim 4, wherein said first link means comprises a pair of first links, and said second link means comprises a pair of second links respectively positioned in parallel relation with said first links, said adjustment member means comprising a pair of adjustment members respectively associated with said pairs of first and second links.

6. The hydraulic wood splitter in accordance with claim 5, wherein said adjustment members each define a plurality of arcuately spaced openings positioned radially about the fixed pivotal connection of each said adjustment member to said respective ones of said first and second links, said locking means further comprising latching means adapted to coact with said spaced openings in said adjustment members to selectively pivotally connect each said adjustment member with said respective other ones of said first and second links.

7. The hydraulic wood splitter in accordance with claim 6, wherein said first links are positioned above said second links, and said adjustment members are respectively fixedly pivotally connected to said second links.

8. The hydraulic wood splitter in accordance with claim 6, wherein said elevating means comprises rigid arm means fixedly connected to one of said first and second link means, and flexible linkage means connected to said rigid arm means and adapted to be selectively operatively connected to said splitting means.

9. A hydraulic wood splitter adapted to be mounted on an implement, comprising:

a front mounting plate adapted to be fixedly mounted on said implement;

a wood-supporting frame connected with said front mounting means and extending rearwardly therefrom;

hydraulically actuated splitting means carried by said wood-supporting frame and movable therealong;

height adjusting means comprising a pair of first upper links, and a pair of second lower links respectively positioned in parallel to said first links for movably connecting said wood-supporting frame and said splitting means to said front mounting means;

elevating means connected with said height adjusting means and selectively movable into operative connection with said splitting means so that movement of said splitting means effects raising and lowering of said wood-supporting frame; and selectively adjustable locking means for releasably locking said wood-supporting frame at a plurality of elevations, said locking means comprising a pair of adjustment members respectively associated with one of each of said first links and said second links, each adjustment member being fixedly pivotally connected to one of its respective first and second links, and selectively pivotally connectable with the other of its respective first and second links in a plurality of positions, said locking means permitting upward movement of said wood-supporting frame by said elevating means before the pivotal connection of each said adjustment members with the other of its respective first and second links is selectively adjusted.

10. The hydraulic wood splitter in accordance with claim 9, wherein said locking means includes a first abutment surface on each of said adjustment members, and a second abutment surface on said ones of the respective first and second links, each said second abutment surface being adapted to engage and coact with the first abutment surface on the respective one of said adjustment members to limit downward movement of said wood-supporting frame attendant to operation of said elevating means by said splitting means.

11. The hydraulic wood splitter in accordance with claim 10, wherein said locking means further includes a pair of latches respectively positioned on said other ones os said first and second links, each of said adjustment members defining a plurality of arcuately spaced openings positioned radially about the fixed pivotal connection of each adjustment member, each said latch being adapted to coact with the spaced openings of the respectively associated one of said adjustment members for selectively pivotally connecting the respective adjustment member to the respective other of said first and second links.

12. The hydraulic wood splitter in accordance with claim 11, wherein said elevating means comprises rigid arm means affixed to one of the pairs of said pair of first links and said pair of second links, and chain means connected to said rigid arm means and adapted to be selectively connected with said splitting means.

13. The hydraulic wood splitter in accordance with claim 12, wherein said wood-supporting frame includes a pair of tubular supports, and said splitting means comprising a ram having sliding collar means slidably movable on said tubular supports, said chain means being adapted for operative connection with said ram.

14. The hydraulic wood splitter in accordance with claim 13, including cutting blade means associated with said wood-supporting frame for coaction with said ram to effect wood splitting.

15. A height adjusting arrangement for mounting an attachment on an implement, comprising:

first mounting means for effecting a fixed mounting on said implement;

rear mounting means for supporting said attachment;

first upper and second lower parallel link means pivotally interconnecting said front and rear mounting means to form four-bar linkage means therewith so that said rear mounting means is vertically movable with respect to said front mounting means; and means for selectively locking said attachment at a plurality of elevations, including adjustment member means fixedly pivotally connected with one of said upper and lower link means, and selectively pivotally connectable with the other of said upper and lower link means in a plurality of positions;

said locking means further including first abutment means defined by said adjustment member means, and second abutment means on one of said upper and lower link means, said first and second abutment means being adapted to positively engage each other to limit downward movement of said attachment and said rear mounting means, while said locking means permits upward movement of said rear mounting means and said attachment thereon before selective adjustment of said pivotal connection of said adjustment member means with the other of said upper and lower link means.

16. The height adjusting mechanism in accordance with claim 15, wherein said adjustment member means defines a plurality of opening means spaced radially about said fixed pivotal connection of said adjustment member means with said one of said upper and lower link means, said locking means further comprising latching means on said other of said upper and lower link means, said latching means being adapted to coact with said spaced opening means to effect said selective pivotal connection of said adjustment member means with said other of said upper and lower link means.

* * * * *